United States Patent [19]

Maier et al.

[11] Patent Number: 4,612,426

[45] Date of Patent: Sep. 16, 1986

[54] ARC CHUTE ASSEMBLY FOR CIRCUIT BREAKER

[75] Inventors: Alfred E. Maier, Chippewa Township, Beaver County; James R. Farley; Nicholas A. Tomasic, both of Plum Borough, all of Pa.

[73] Assignee: Westinghouse Electric Corp., Pittsburgh, Pa.

[21] Appl. No.: 768,774

[22] Filed: Aug. 23, 1985

[51] Int. Cl.[4] ..... H01H 33/08

[52] U.S. Cl. ..... 200/144 R; 200/147 R

[58] Field of Search ..... 200/144 R, 147 R

[56] References Cited

U.S. PATENT DOCUMENTS

| | | | |
|---|---|---|---|
| 2,551,822 | 5/1951 | Bingenheimer et al. | 200/144 R |
| 2,911,505 | 11/1959 | Legg et al. | 200/144 R |
| 3,243,559 | 3/1966 | Heft | 200/144 R |
| 3,260,822 | 7/1966 | Stephenson, Jr. et al. | 335/201 |
| 3,749,867 | 7/1973 | Rexroad | 200/147 R |
| 4,107,497 | 8/1978 | Jencks et al. | 200/144 R |
| 4,143,256 | 3/1979 | Ciarcia | 200/144 R |
| 4,229,630 | 11/1980 | Wafer et al. | 200/144 R |

*Primary Examiner*—Robert S. Macon

*Attorney, Agent, or Firm*—D. S. Buleza

[57] ABSTRACT

An arc chute assembly for a circuit breaker or similar device comprising a series of metallic arc chute plates that are locked in stacked spaced-apart relationship between a pair of insulative side panels by elongated key members of non-conductive material that are wedged between the flat surfaces of the side panels and notched portions of pairs of T-shaped tabs which extend from each side edge of the respective plates. The tabs interlockingly engage a series of laterally-extending slot openings in the side panels in such a manner that the key members are in press-fitted engagement with only one of the tabs in each pair of tabs.

12 Claims, 9 Drawing Figures

ARC CHUTE ASSEMBLY FOR CIRCUIT BREAKER

BACKGROUND OF THE INVENTION

1. Field of the Invention

This invention generally relates to circuit interrupter apparatus and, more particularly, to an improved arc chute assembly for a circuit breaker of the low voltage type.

2. Description of the Prior Art

It is common practice in the low voltage circuit breaker art to employ an arc chute assembly to extinguish the arc that is produced when the circuit breaker is tripped and the contacts are rapidly opened. Such arc chute assemblies consist of a plurality of metallic chute plates that are held in stacked spaced-apart relationship by side panels and a back panel that are fabricated from electrically non-conductiuve material. Retention of the chute plates in assembled relationship was usually achieved by providing them with small tabs which were slipped into a series of openings in the side panels and then staked or spun over at final assembly. Such staking and spinning operations were not only expensive and time consuming but frequently damaged the protective finish or plating that is provided on the arc chute plates to prevent rusting and enhance their arc-extinguishing ability. An arc chute assembly having staked arc chute plates that are coated with a weld deterrent material such as silicone varnish is disclosed in U.S. Pat. No. 4,143,256 (Ciarcia).

An improved arc chute assembly having arc plates that are provided with notched tangs which interfit with slots in the insulative side panels and are locked in place by an insulative back panel which engages apertures in the side panels in snap-fitting relationship is disclosed in U.S. Pat. No. 4,107,497 issued Aug. 15, 1978 to Jencks et al.

Various other types of arc chute assemblies and means for keeping the components in stacked operative relationship are disclosed in the following U.S. Pat. Nos. 2,551,822 (Bingenheimer et al.), 2,911,505 (Legg et al.), 3,243,559 (Heft), 3,749,867 (Rexroad) and 4,229,630 (Wafer et al.).

While the prior art arc chute assemblies were satisfactory from a functional standpoint they were difficult and expensive to manufacture in that they required staking or spinning of arc plate material to lock the plates in place or a temporary deformation of the chute components to effect a snap fit with the back panel and thus hold the assembly in the desired form. It would accordingly be advantageous from both a cost and manufacturing standpoint if such staking, spinning and snap-fitting operations could be entirely eliminated during fabrication of arc chute assemblies designed for use in circuit breakers and similar apparatus.

SUMMARY OF THE INVENTION

The present invention achieves the foregoing objectives and other advantages by providing an arc chute assembly for a circuit interrupter which permits the chute plates to be assembled with the side and back panels quickly and in precise relationship and then be securely locked in place solely by the frictional wedging action of a pair of specially-shaped key members that engage T-shaped tabs provided on each of the chute plates. A pair of such tabs are formed along each side of the plates and the tabs are shaped and dimensioned to slip into and interlock with a series of paired slot openings in each of the side panels. The configuration of the slot openings and tabs is such that when the chute plate tabs are inserted into paired slot openings in the side panels and then sequentially shifted in one direction and then in the opposite direction, the tabs are seated in alternate fashion against the edges of the slot openings in the side panels and interlock the side panels and chute plates in loose-fitting assembled relationship. The pair of elongated key members are fabricated from insulative sheet material and adapted to be forcibly inserted into the spaces between surfaces of the respective side panels and the protruding ends of the tabs, thus tightly clamping the chute plates in interlocked relationship with the side panels and providing a rugged unitary arc chute assembly.

The novel key-locking arrangement of the present invention thus permits the arc chute plates to be assembled with the side panels in an efficient manner without the need for any staking or snap interfitting of the parts and without damaging the chute plates in any way.

BRIEF DESCRIPTION OF THE DRAWINGS

A better understanding of the invention will be obtained from the exemplary embodiment of the invention shown in the accompanying drawings, wherein.

DESCRIPTION OF THE PREFERRED EMBODIMENT

While the improved arc chute assembly of the present invention can be employed in various kinds of electrical switching and circuit-interrupting apparatus which have separable contacts that inherently produce an arc when they are opened, it is particularly adapted for use in conjunction with low voltage circuit breakers and it has accordingly been so illustrated and will be so described.

Figure 1:
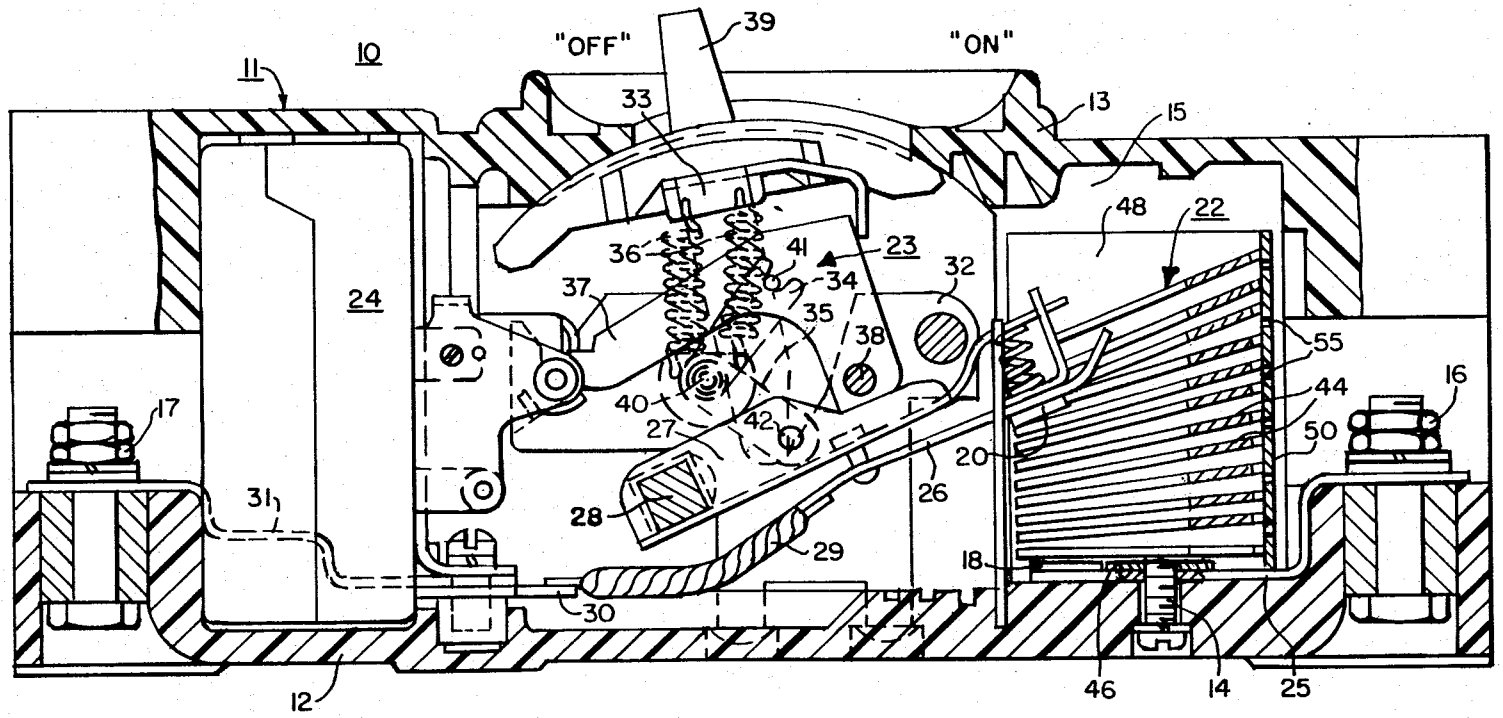
FIG. 1 is a sectional view through the center pole portion of a three-pole circuit breaker of the low voltage type which incorporates the improved arc chute assembly of the present invention.

In FIG. 1 there is shown a molded case three-pole circuit breaker 10 which comprises an insulating housing 11 that includes a base 12 and a removable cover 13. Insulating barrier means 15 within the housing 11 defines, in conjunction with the base 12 and cover 13, three adjacent compartments that contain the three pole units. A pair of terminals 16 and 17 are provided in cavities at opposite sides of each of the pole units for connecting the respective pole units to an electrical circuit. A circuit breaker of this type is described in detail in U.S. Pat. No. 3,260,822 (Stephenson, Jr. et al.) and only a generalized description of the structural and operational features of the breaker will accordingly be presented.

Each of the pole units of the circuit breaker 10 has the usual stationary contact 18 and movable contact 20 that are located within the confines of an arc chute assembly 22 which defines an arc-extinguishing chamber. A common operating mechanism 23 is provided for simultaneously actuating the three movable contacts to their open and closed positions. A suitable trip device, indicated generally at 24, initiates the automatic opening of the breaker contacts 18, 20 in response to circuit-overload conditions in the manner well known to those skilled in the art. The terminal 16 is secured to the outer end of a conducting strip 25 which extends into the housing 11 and supports the stationary contact 18. The movable contact 20 is mounted on a contact arm 26 that is supported on a switch arm 27 connected to an insulating tie bar 28 which extends across all three pole units of the circuit breaker 10 and thus permits the switch arms of the several pole units to move as a unit. The tie bar 28 is suitably supported in the housing 11 for movement about an axis between "contact-open" and "contact-closed" positions. The contact arm 26 is connected by a flexible conductor 29 to another conductor 30 which, in turn, is fastened to a main conductor 31 that is secured to the base 12 and extends through the trip unit 24 to the other terminal 17 with which it is connected.

The operating mechanism 23 is located in the center compartment of the breaker housing 11 and is supported on a pair of spaced frame members 32 (only one of which is shown in FIG. 1) that extend upwardly from the base 12. The operating mechanism 23 comprises a generally U-shaped operating lever 33, a toggle assembly consisting of toggle links 34 and 35, a pair of overcenter springs 36 and a releasable cradle or trip memeber 37 that is controlled by the trip device 24. The legs of the operating lever 33 are pivotally supported at their inner ends in U-shaped slots in the spaced frame members 32 and trip member 37 is pivotally supported on a pin 38 that is anchored to and extends between the frame members. An insulating handle 39 is secured to the outer end of the operating lever 33 and extends through an opening in the cover 13 to permit manual operation of the circuit breaker 10.

The toggle links 34, 35 are pivotally connected together by a knee pivot 40 and the upper end of the link 34 is pivotally connected to the trip member 37 by a pin 41. The lower end of the toggle link 35 is pivotally connected to the switch arm 27 of the center pole unit by a pin 42 and the springs 36 are connected under tension between the outer end of the operating lever 33 and the knee pivot 40 of the toggle 34, 35 in the well known manner.

The circuit breaker 10 is manually operated to the open position (shown in FIG. 1) by counterclockwise movement of the handle 39 to the "OFF" position, which movement actuates the overcenter springs 36 and causes the toggle 34, 35 to collapse and shift the switch arms 27 of all of the pole units to their "contact-open" positions in the well known manner. The breaker 10 is manually closed by moving the handle 39 in a clockwise direction to the "ON" position, which movement causes the overcenter springs 36 to pull the toggle 34, 35 to erect position and shift the switch arms 27 of all of the pole units to their "contact-closed" positions in the manner well known to those skilled in the art.

As will be noted in FIG. 1, the arc chute assemblies 22 are anchored in each of the three compartments adjacent the respective pairs of separable contacts 18, 20 and comprise a series of arc chute plates 44 that are held in spaced vertically-stacked relationship by side panels 48 and a back panel 50 and are thus adapted to interrupt and extinguish the arc which forms when the circuit breaker is tripped and the contacts 18 and 20 are suddenly opened. The back panel 50 has a series of vent openings 55 to permit the hot gases and arc-debris to escape from the arc-extinguishing chambers. The arc chute assemblies 22 are secured to the base 12 by suitable fasteners such as bolts 14 that engage threaded apertures in the bottom plates 46 of the chute assemblies 22, thus connecting the bottom plates 46 to the conducting strip 25 and the stationary contact 18. Since the bottom plates 46 are fabricated from metal they serve as arc-runner components within the respective pole unit of the circuit breaker 10.

Figure 2:
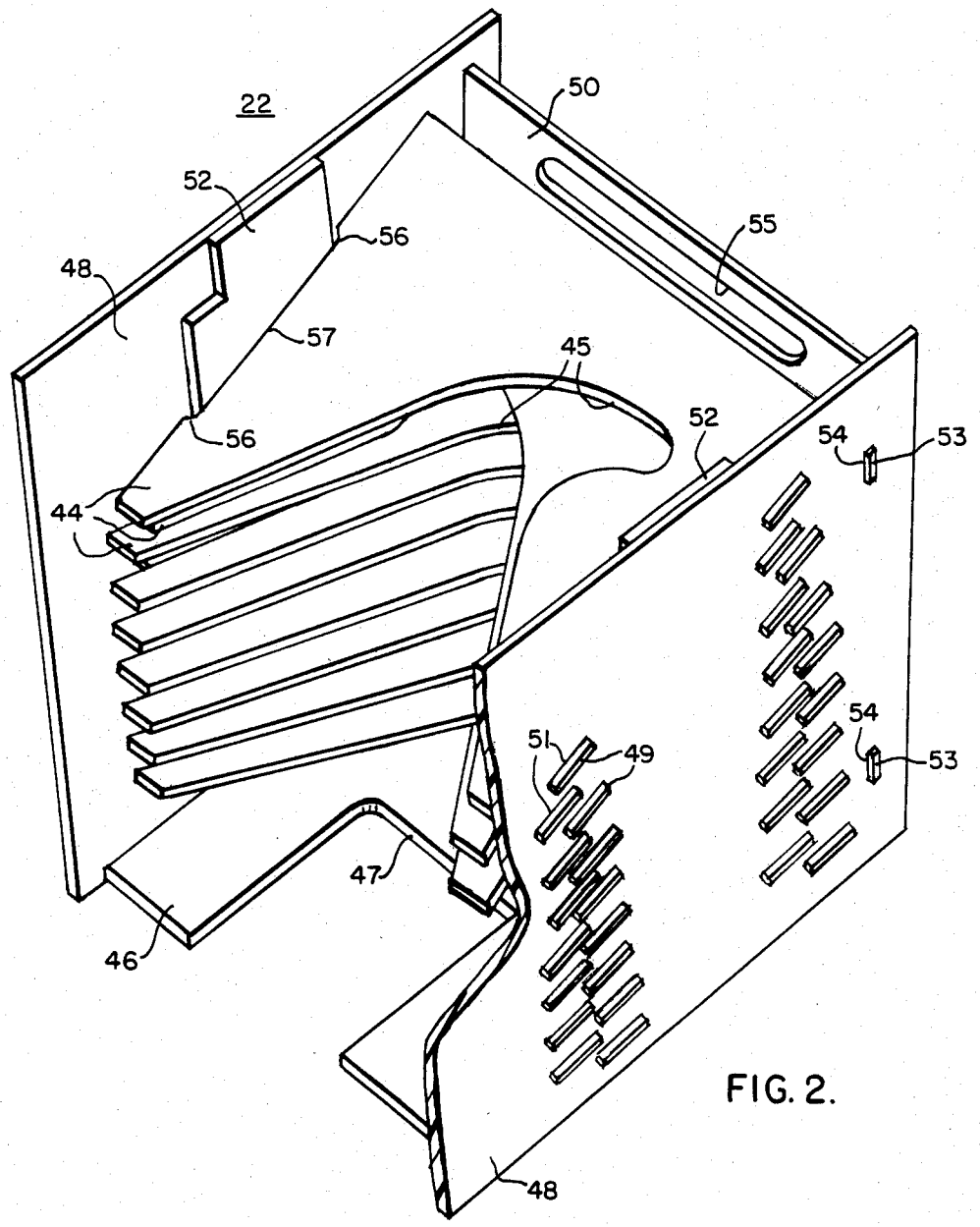
FIG.2 is an enlarged pictorial view, partly in section, of one of the improved arc chute assemblies used in the circuit breaker shown in FIG. 1.

The arc chute assemblies 22 are constructed in a unique manner in accordance with the present invention and these components of the circuit breaker 10 will now be described in detail. As illustrated in FIG. 2, each of the arc chute assemblies 22 comprises a series of chute plates 44 that are arranged in vertically-stacked spaced-apart relationship, along with the bottom plate 46, between a pair of side members or panels 48 that are secured to the back panel 50. The arc chute plates 44 and bottom plate 46 are fabricated from suitable metal (such as sheet steel) that has been provided with a suitable protective coating or plating to prevent rusting. The side panels 48 and back panel 50 are fabricated from suitable electrically non-conductive material (such as glass fiber reinforced polyester) that is rigid and durable. Each of the arc chute plates 44 is provided with a curved opening 45 that extends from one end of the plate toward the opposite end and is skewed or elongated toward a corner of the arc chute assembly 22. The plate openings 45 are aligned and so shaped that the skewed ends of the openings in adjacent plates extend toward opposite corners of the chute assembly 22, as shown in FIG. 2. This facilitates interruption of the arc since the chute plates 44 not only divide the arc into small segments but direct the arc segments toward opposite corners of the chute assembly 22. The plate 46 at the bottom of the chute assembly 22 is provided with a rectangular opening 47 that extends inwardly from its leading edge to permit the movable contact 20 and contact arm 26 to move downwardly through the passageway provided by the chute openings 45, 47 and engage the stationary contact 18.

The arc chute plates 44 are retained in stacked and spaced relationship between the side panels 48 by a series of laterally protruding prongs such as T-shaped tabs 49 that project through a plurality of laterally-extending slot openings 51 in the side panels 48 and are clamped in seated interlocked engagement therewith by a pair of key members 52 that extend along the inner surfaces of the side panels 48 and are wedged against the notched portions of the chute tabs 49 in the manner hereinafter described. The back panel 50 is also locked in place by a pair of prongs or tabs 53 that protrude laterally from each side of the panel and engage and are interlocked with vertically extending slot openings 54 in the rearward portions of the side panels 48. The back panel 50 is also provided with a plurality of laterally extending vent openings 55 to permit the gases and debris formed by the arc to be expelled from the arc chute assembly 22 and thus aid in the deionization process.

Figure 3:
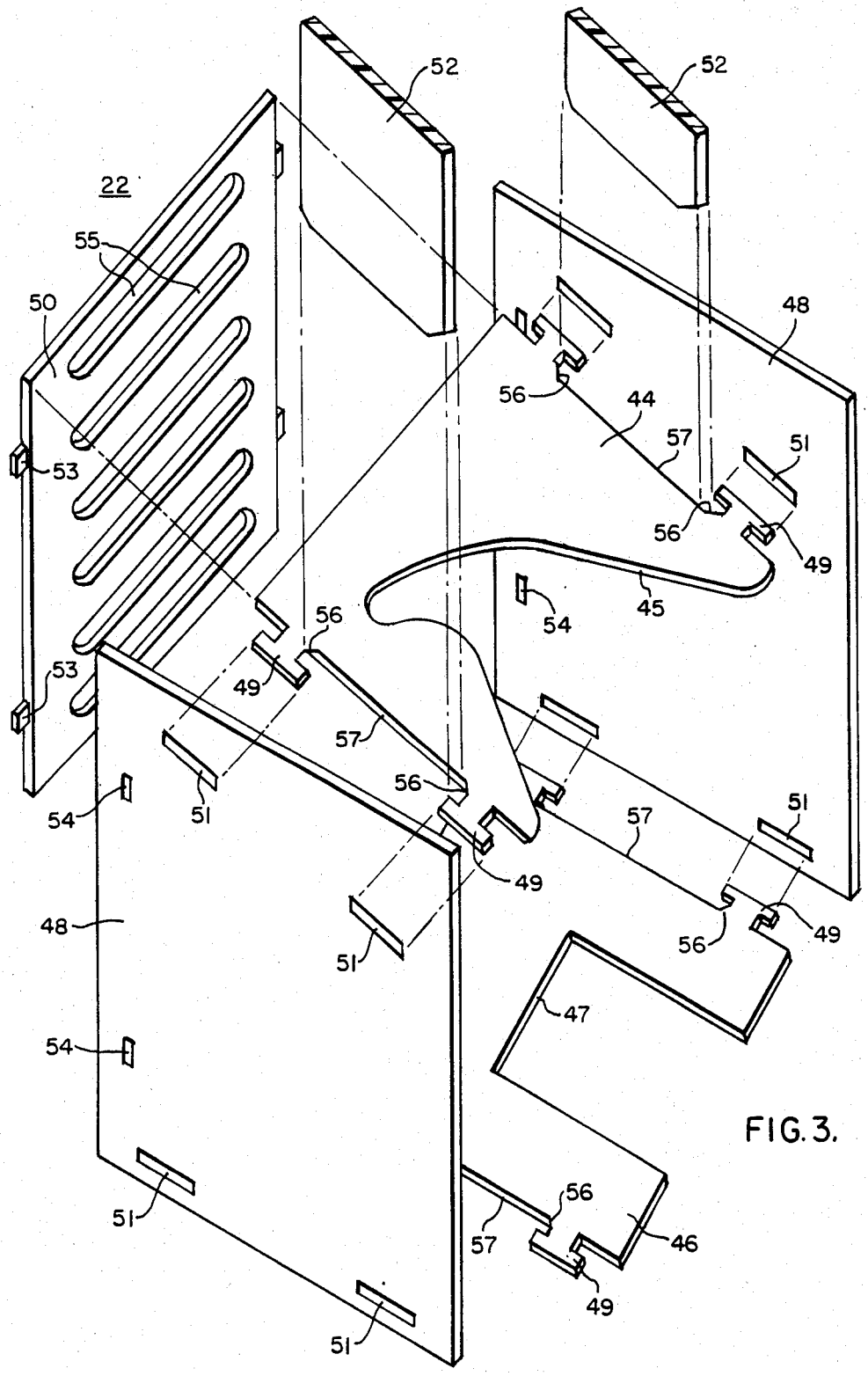
FIG. 3 is an exploded pictorial view of the arc chute assembly shown in FIG. 2, only one of the chute plates and bottom plate and only the end portions of the locking-key members being shown to facilitate the illustration.

A better understanding of the configuration of the various components of the arc chute assembly 22 and the manner in which they are interlocked with one another to form a rigid unitary structure will be obtained from the exploded view of the assembly shown in FIG. 3. As will be noted, each side of the chute plates 44 have a pair of tabs 49 that extend from the plates and are T-shaped. The root portions 56 of the tabs 49 which comprise the inwardly disposed edges of the tab notches are tapered toward one another so that the side edges 57 of each of the chute plates 44 and bottom plate 46 that extend between the tabs 49 are offset inwardly from the side edges of the plates located beyond the respective tabs. This is an important feature of the invention insofar as the tapered root portions 56 and the resulting offset side edge portions 57 of the chute plates 44 and bottom plate 46 form pockets for the key members 52 when the chute plates 44 are in assembled interlocked relationship with the side panels 48.

Figure 4:
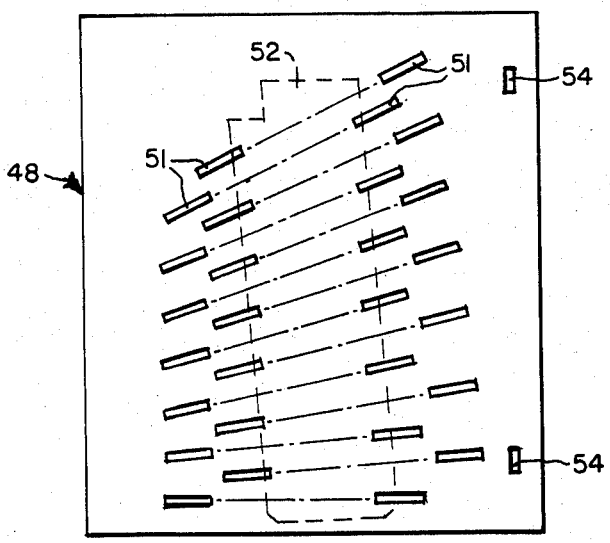
FIGS. 4, 5 and 6 are side elevational views of one of the side panels, the back panel and one of the locking-key members, respectively, for the arc chute assembly shown in FIGS. 2 and 3.

The tabs 53 which protrude from the side edges of the back panel 50 are rectangular shape and make a snug fit with correspondingly shaped slot openings 54 that are aligned with one another and extend vertically along the rear portion of each of the side panels 48. In contrast, the paired slot openings 51 which receive the chute plate and bottom plate tabs 49 extend horizontally and (as shown in FIGS. 2, 3 and 4) and are laterally offset from one another in alternating fashion so that the vertically adjacent openings are staggered relative to one another. The paired slot openings 51 also have a slight downward slope so that the arc chute plates 44 (except the bottom plate 46) also slope downwardly toward the stationary contact 18 located at the bottom of the circuit breaker housing 11.

Assembly of the arc chute structure 22 is achieved by first placing the chute plates 44, 46 in the desired stacked relationship (with the aid of a suitable jig or holder) and then slipping the tabs 49 on one side of the stacked plates through the proper sets of paired offset slot openings 51 in one of the side panels 48. The tabs 53 on one side of the back panel 50 are then inserted into the slots 54 of the side panel 48 and the other side panel 48 is aligned with and slipped over the tabs 49, 53 on the other sides of the individual chute plates 44, 46 and back panel 50. The first (or uppermost) chute plate 44 in the stack is then shifted in a forward direction (away from the back panel 50) and the succeeding plates 44, 46 in the stack are alternately shifted in rearward and forward directions so that the notched portions of the pairs of T-shaped tabs 49 are seated against the forward or rearward ends of the associated pairs of slot openings 51 in the side panels 48, depending upon the direction in which the individual chute plates 44, 46 were shifted. Such shifting of the arc chute plates 44, 46 loosely interlocks them with the side panels 48 and is readily accomplished since each of the T-shaped tabs 49 are of the same configuration and of such size and dimension that they slip into and through the respective pairs of slot openings 51 which are also of uniform shape and size. The loosely interlocked arc chute assembly 22 is then placed in an upright position for the final step in the fabrication process.

The shifting of alternate arc chute plates 44, 46 in forward and rearward directions and the staggered orientation of the paired slot openings 51 causes the vertically stacked plates and tabs 49 to be slightly staggered and offset from one another, as shown in FIG. 2. This forms vertically extending pockets for the rectangular key members 52 which are then inserted (as shown in FIG. 3) into such pockets along and between the inner surfaces of the respective side panels 48 and the offset side edges 57 of the chute plates 44, 46. The key members 52 are forcibly driven into the notches of the tabs 49 located at opposite ends of alternate plates 44, 46 and thus tightly wedge the tabs of the alternate plates against oppositely disposed ends of the associated pairs of slot openings 51. The inserted key members 52 thus engage only one of the tabs 49 on each side of the stacked plates 44, 46. However, since the engaged tabs 49 are located at the opposite ends of adjacent plates 44, 46 in the stack and the key members 52 thus apply pressure to the adjacent plates in opposite directions, the net result is that all of the plates 44, 46 are securely and tightly clamped to the side panels 48. The back panel 50 is also locked in place since both side panels 48 are seated against the side edges of the back panel and keep the tabs 53 interlocked with the openings 54.

The staggered relationship and slight downward slope or tilt of the axes of the paired slot openings 51 are clearly shown in FIG. 4 which depicts one of the side panels 48. The associated key member 52 is shown in phantom outline to illustrate its position relative to the slot openings 51 when the key member is in its inserted locking position. As will be noted, the side edges of the key member 52 intersects each of the slot openings 51 that are closest to the center line of the side panel 48 but is remote from the other slot openings 51 in the respective pairs of openings. Thus, the key member 52 engages and effects a tight interference fit with only the plate tabs 49 that are inserted into the inwardly-located sets of slot openings 51 and then seated in interlocked relationship with the side panel 48 when the plates 44, 46 are alternately shifted in opposite directions as described previously.

Figure 5:
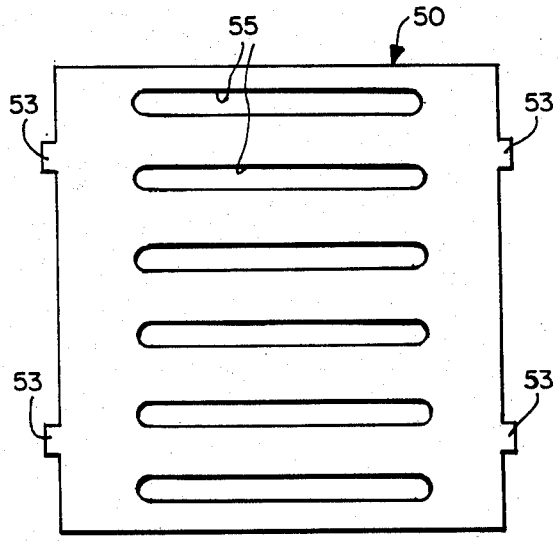

As will be noted in FIG. 5, the back panel 50 has four rectangular-shaped prongs or tabs 53 which protrude from opposite sides of the panel in paired relationship. It also has a plurality of horizontally extending vent openings 55 described previously.

Figure 6:
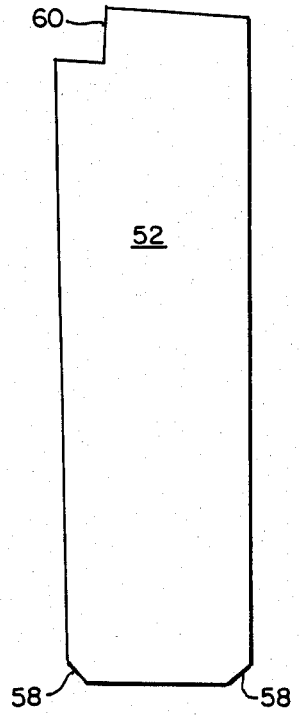

One of the key members 52 is shown in FIG. 6 and comprises an elongated member of generally rectangular configuration with straight parallel side edges. The corners at one end of the key member 52 are cut to provide tapered surfaces 58 that facilitate the insertion of the key members into the gaps between the chute tabs 44, 46 and the respective side panels 48. In order to avoid short-circuiting the arc chute plates 44, 46, the key members 52 are fabricated from a suitable electrically non-conductive, non-tracking hard material (such as acetal) which off-gases when exposed to heat and will thus aid in extinguishing the arc. The top portion of the key member 52 is also provided with a cutout 60 to permit it to be easily gripped with a tool and removed if necessary.

Figure 7:
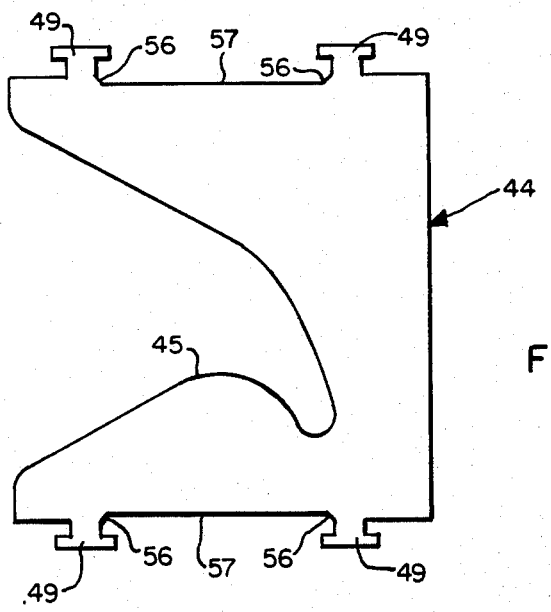
FIG. 7 is a plan view of one of the arc chute plates.

The structural details of the arc chute plates 44 are shown in FIG. 7, particularly the tapered root segments 56 at the inwardly-facing edges of the T-shaped tabs 49 and the resulting offset side edges 57 of the plates which provide the recesses for accommodating the locking-key members 52 when the chute plates 44 are in assembled relationship with the side panels 48.

Figure 8:
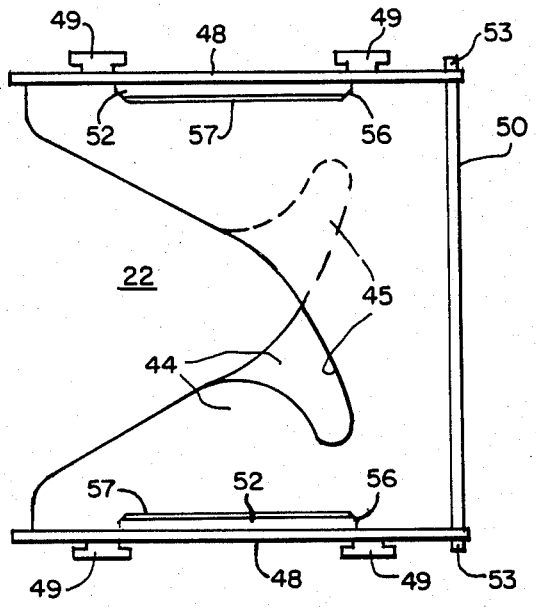
FIG. 8 is a top plan view of the finished arc chute assembly shown in FIG. 2.
Figure 9:
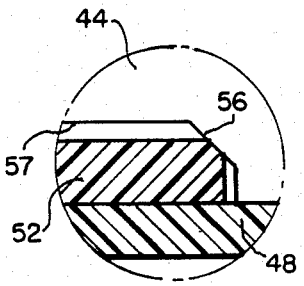
FIG. 9 is an enlarged cross-sectional view of one of the plate-locking sites illustrating the wedging interference fit between one of the T-shaped tabs on the chute plates and the associated inserted key member.

A more detailed showing of the manner in which the key members 52 are locked in inserted position in the arc chute assembly 22 is illustrated in FIGS. 8 and 9. As will be noted, the thickness and width of the key members 52 are such that the corners of the key members make such a tight interference fit with the tapered root segments 56 of the respective chute tabs 49 that the corners of the key members 52 are "shaved off" and removed as the key members are forcibly driven into their locking positions within the arc chute assembly 22. This controlled interference fit between the corners of the key members 52 and the arc chute plates 44, 46 not only insures that the chute components are positively and securely locked together but allows for small variations in the manufacturing tolerances of the parts, as indicated by the small gaps between the face and side edge portions of the key member 52 and the adjacent surfaces of the associated chute plates 44 shown in FIG. 9.

It is within the scope of the invention to use key members that are driven into locked positions between the T-shaped tabs of individual arc chute plates along the outer faces of the side panels of the chute assembly rather than along the inner faces of the side panels as in the illustrated embodiment. Such exterior placement of the locking-key members would require that the tapered segments 56 be located at the juncture of the bar portion with the root portions of the T-shaped tabs if the desirable controlled-interference fit between selected ones of the tabs and the inserted key members is to be obtained, along with the automatic accomodation of the small variations in the dimensions, etc., of the parts which normally occur during manufacture.

We claim as our invention:

1. In combination with a circuit breaker having a pair of separable contacts and operating means adapted to open the contacts in response to line overload conditions, an arc chute assembly located adjacent the separable contacts and comprising;

a pair of side members and a back member disposed to define an arc-extinguishing chamber, a plurality of arc chute plates supported in stacked spaced-apart relationship between said side members, each of said plates having a pair of tabs that extend from each side of the respective plates through and beyond slot openings in the side members, said tabs being notched to permit shifting of the plates into interlocking engagement with the side members after the tabs have been inserted into the respective slot openings and said tabs also being configured to provide gaps between the tabs and adjacent surfaces of the side members, and means locking the arc chute plates to the respective side members comprising a pair of elongated key members disposed in said gaps in tightly-wedged relationship between the face of the respective side members and the notched portions of the associated tabs of the arc chute plates.

2. The combination of claim 1 wherein;

one of the separable contacts of the circuit breaker is movable and the other contact is stationary, the arc chute plates each have an opening therein that extends inwardly from the edge of the plate facing the separable contacts, and the arc chute openings define a passageway for the movable contact when the circuit breaker is operated and the contacts are opened and closed.

3. The combination of claim 2 wherein;

the stationary contact is located at the bottom of the arc-extinguishing chamber defined by the arc chute assembly, and the movable contact is movable along said passageway in proximate relationship with the edges of the arc chute plates.

4. The combination of claim 3 wherein;

said arc chute plates are fabricated from sheet metal and the spacing therebetween is substantially uniform, the key members and side and back members are fabricated from insulative material, and the back member is held in place by tabs which extend from the sides of the back member into apertures in the side members which effect an interlocking fit therewith.

5. An arc chute assembly that is adapted for use in a circuit breaker and similar apparatus and comprises;

a pair of side members disposed in upstanding spaced-apart relationship and providing opposed side walls each having a series of laterally extending slot openings therein arranged in pairs, a plurality of arc chute plates disposed between said side members and arranged in stacked laterally-extending spaced-apart relationship, each of said plates having side edges from which a pair of T-shaped tabs protrude and the pairs of slot openings in said side members being so located and dimensioned that the paired T-shaped tabs extend through and beyond selected pairs of slot openings, said plates being shifted in alternating opposite directions so that the pairs of T-shaped tabs interlockingly engage the associated pair of slot openings at only one end of said openings and are thus interlocked with the side members, and means locking the stack of arc chute plates in interlocked stacked relationship with said side members comprising a pair of key members of elongated configuration that extend along the respective side members between the paired tabs of the individual arc chute plates and are in tightly-wedged relationship with notched portions of only one tab in each pair of tabs and also with the proximate wall surfaces of the side members.

6. The arc chute assembly of claim 5 wherein;

said plates are fabricated from sheet metal and are substantially the same size, and said side members and key members are fabricated from electrically non-conductive material.

7. The arc chute assembly of claim 6 wherein;

the side members comprise a pair of panels with the slot openings in each pair of slot openings spaced substantially the same distance apart and with the successive pairs of slot openings laterally offset from the adjacent pairs of such openings a predetermined distance in one direction and then in the opposite direction so that alternate pairs of slot openings are in substantial alignment, and said side panels are of substantially the same size and configuration and the slot openings therein are substantially identical both in size and in paired orientation.

8. The arc chute assembly of claim 7 wherein the back of the assembly is closed by a back panel of electrically non-conductive material that is locked in place by tabs that extend from the side edges of the back panel and extend into and interlockingly engage a corresponding number of apertures in the rearward portions of the respective side panels.

9. The arc chute assembly of claim 6 wherein;

each of the said T-shaped tabs extend beyond the outer surfaces of the respective side panels a predetermined distance and thus leave a gap between the inner edge portion of the tab and the adjacent wall surface of the side panels, and said elongated key members have substantially straight parallel side edges and are disposed in seated position against the outer surfaces of the side panels in tightly-wedged engagement with the inwardly-disposed notched portions of the T-shaped tabs.

10. The arc chute assembly of claim 7 wherein;

the arc chute plates are laterally shifted into paired slot openings alternately in opposite directions so that the tabs in each pair of tabs are seated against alternately opposed ends of the slot openings in the associated pairs of slot openings, and said key members are of generally rectangular elongated configuration and extend along and are seated against the inner wall surfaces of the side panels with the side edges of the key members tightly wedged between alternately-positioned tabs of said pairs of tabs that are aligned above the other.

11. The arc chute assembly of claim 7 wherein;

the side edge portions of the arc chute plates extending between the associated pair of T-shaped tabs is undercut and provides an offset straight edge portion on each side of the plates and thus forms a recess which accommodates the thickness of the associated key members.

12. The arc chute assembly of claim 11 wherein;

the root portions of each of the T-shaped tabs that are contiguous with the offset edge portions of the arc chute plates are tapered toward one another and thus provide knife edges which shear off the corner portions of the associated key members as the key members are inserted into position and thus effect a tight interference fit with the respective key members at a plurality of spaced points along their length.

* * * * *